US008558753B2

(12) United States Patent
Haight

(10) Patent No.: US 8,558,753 B2
(45) Date of Patent: Oct. 15, 2013

(54) METHOD FOR ASSEMBLY OF A SEGMENTED REFLECTOR ANTENNA

(75) Inventor: Richard Haight, Whitby (CA)

(73) Assignee: ASC Signal Corporation, Plano, TX (US)

( * ) Notice: Subject to any disclaimer, the term of this patent is extended or adjusted under 35 U.S.C. 154(b) by 303 days.

(21) Appl. No.: 13/105,479

(22) Filed: May 11, 2011

(65) Prior Publication Data

US 2011/0209339 A1 Sep. 1, 2011

Related U.S. Application Data

(62) Division of application No. 12/126,439, filed on May 23, 2008, now Pat. No. 7,965,255.

(60) Provisional application No. 60/940,030, filed on May 24, 2007.

(51) Int. Cl.
*H01Q 3/02* (2006.01)
*H01Q 15/14* (2006.01)

(52) U.S. Cl.
USPC ..... 343/882; 343/912; 343/915; 343/916

(58) Field of Classification Search
None
See application file for complete search history.

(56) References Cited

U.S. PATENT DOCUMENTS

| | | | | | |
|---|---|---|---|---|---|
| 3,715,760 | A * | 2/1973 | Palmer | 343/915 |
| 4,506,271 | A * | 3/1985 | Gonzalez | 343/915 |
| 4,529,277 | A * | 7/1985 | Gee et al. | 359/854 |
| 4,593,132 | A * | 6/1986 | Kita et al. | 570/150 |
| 4,994,816 | A | 2/1991 | Kondo | |
| 5,050,976 | A * | 9/1991 | Flint | 359/851 |
| 5,184,145 | A | 2/1993 | Devillers et al. | |
| 5,255,006 | A * | 10/1993 | Pappas et al. | 343/915 |
| 5,257,034 | A * | 10/1993 | Turner et al. | 343/915 |
| 5,646,638 | A | 7/1997 | Winegard et al. | |
| 6,433,757 | B1 * | 8/2002 | Shrader | 343/915 |
| 7,023,401 | B2 * | 4/2006 | Thrash et al. | 343/915 |
| 7,230,581 | B2 | 6/2007 | McEwan | |
| 7,965,255 | B2 * | 6/2011 | Haight | 343/882 |
| 7,965,256 | B2 * | 6/2011 | Haight | 343/915 |
| 2008/0290228 | A1 * | 11/2008 | Haight | 248/183.2 |

OTHER PUBLICATIONS

GIGASAT Product Brochure: FA-370 Antenna; downloaded in the US from URL: http://www.gigasat.com/products/flyawayantennas_new.htm on May 20, 2008. Original publication date unknown.

* cited by examiner

*Primary Examiner* — Trinh Dinh

(74) *Attorney, Agent, or Firm* — Babcock IP, PLLC

(57) ABSTRACT

A method for assembly of a segmented reflector antenna, including coupling a central segment upon an antenna mount. Attaching a peripheral segment to a bottom portion of the central segment. Rotating the central segment to present a bottom portion of the central segment without a peripheral segment, and attaching a peripheral segment to the bottom portion. In additional steps, a secondary ring of peripheral segments may be applied, each connected to an outer edge of a peripheral segment connected to the bottom portion of the central segment.

9 Claims, 8 Drawing Sheets

METHOD FOR ASSEMBLY OF A SEGMENTED REFLECTOR ANTENNA

CROSS REFERENCE TO RELATED APPLICATIONS

This application is a Division of prior U.S. Utility patent application Ser. No. 12/126,439, titled "Rotatable Antenna Mount", filed May 23, 2008 by Richard Haight, now U.S. Pat. No. 7,965,244, which claims the benefit of U.S. Provisional Patent Application No. 60/940,030, titled "Rotatable Antenna Mount", filed May 24, 2007 by Richard Haight. Both prior applications hereby incorporated by reference in their respective entireties.

Also demonstrative of related aspects of a Mobile Antenna System that incorporates elements of the invention are two U.S. Utility patent applications 1) Ser. No. 12/126,434, titled "Segmented Antenna Reflector" and 2) Ser. No. 12/126,448, titled "Mobile Antenna Support", both applications by Richard Haight inventor of the present invention, both filed May 23, 2008 and both hereby incorporated by reference in their respective entireties.

BACKGROUND

Earth Station Antennas utilize a reflector to concentrate satellite signals upon a sub reflector and or feed assembly. A large reflector concentrates weak signals, enabling low power high bandwidth satellite communications.

Large reflectors may be formed from a plurality of segments that are interconnected to form the desired reflector surface. Because reflector segments need to be attached across the expanse of the reflector, that is at the top edge as well as the bottom edge, large reflectors, for example with diameters greater than two meters, are typically assembled and or installed with the assistance of overhead heavy lift equipment, a limitation that significantly impacts the practicality of large diameter reflectors in earth station antenna systems with mobility and quick assembly requirements.

Therefore, it is an object of the invention to provide a method and apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

The inventor has recognized that, for maximum mobility and minimized assembly logistics, a significant limitation of large diameter reflector antennas is the prior requirement for overhead lift capacity at the point of assembly. An antenna equipped with a rotatable antenna mount according to the invention may be designed using reflector segments as large as may be practically manipulated at ground level, without requiring overhead lift capacity at the point of assembly.

Figure 1:
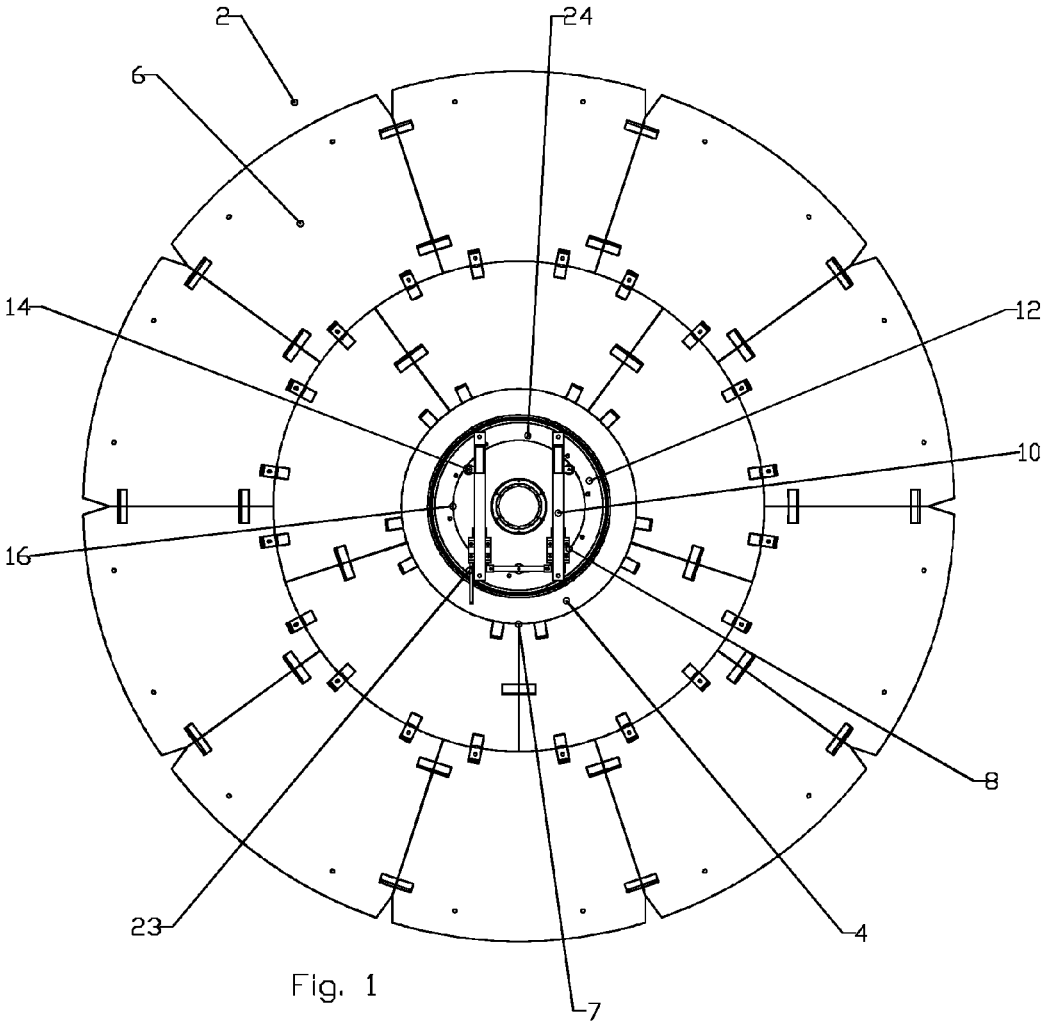
FIG. 1 is an isometric back view of an exemplary first embodiment, mounted upon a segmented reflector.
Figure 2:
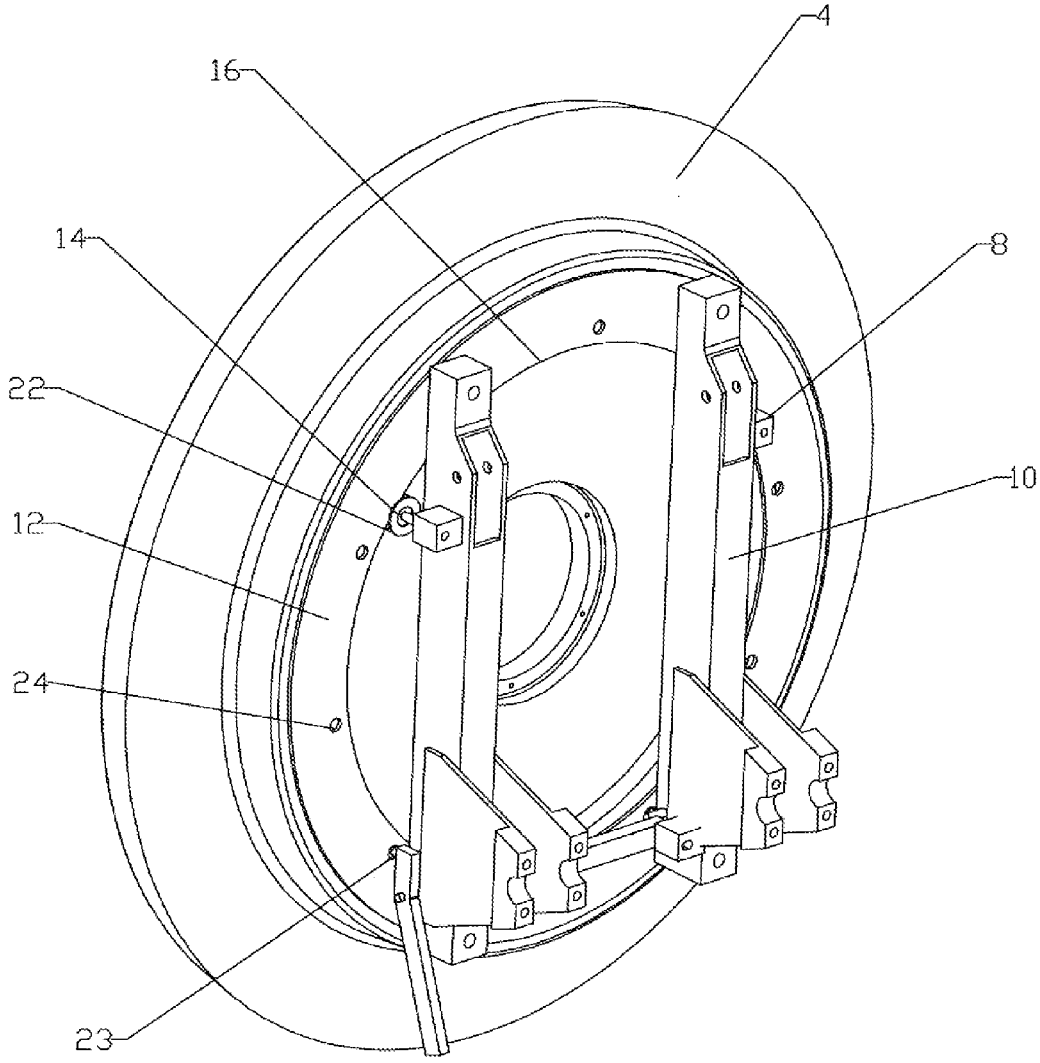
FIG. 2 is a close-up isometric view of FIG. 1, with the reflector peripheral reflector segments and segment interconnection features removed for clarity.

A first exemplary embodiment of the rotatable antenna mount is described with reference to FIGS. 1 and 2.

The reflector 2 is comprised of, for example, a central segment 4 to which a plurality of peripheral segment(s) 6 are each attached. To decrease the peripheral segment 6 size requirements, secondary and or multiple rings of peripheral segment(s) 6 may be attached to an outer edge of each successive ring of peripheral segment(s) 6. The central segment 4 has a rotatable connection 8 to an antenna mount 10. The antenna mount 10 is then coupled to a conventional reflector antenna support structure, not shown, adjustable in azimuth and or elevation to orient the reflector 2 as desired, for example into alignment with a desired RF signal source/target such as a satellite. The rotatable connection 8 enables rotation of the reflector 2 about an axis normal to a reflector connection plane of the antenna mount 10, enabling assembly and disassembly of the reflector from the bottom position.

The rotatable connection 8 is demonstrated as a generally planar ring shaped disk 12 coupled to the central segment 4 in a spaced away orientation. The disk 12 may be directly coupled to the central segment 4 via welding, bonding or via fasteners such as bolts or rivets. The disk 12 is hung upon a plurality of retaining roller(s) 14 connected to the antenna mount 10. The retaining roller(s) 14 are positioned along an upper portion of the antenna mount 10 to run along an inner diameter 16 of a bore of the disk 12. Friction reducing devices, such as support rollers and or wear pads 18 (see FIGS. 3 and 4) may also be positioned at contact points between the outer surface 20 of the disk 12 and the antenna mount 10, generally in-line with the reflector connection plane. An annular groove 22 formed around an outer diameter of at least one of the retaining roller(s) 14 keys the reflector 2 to the antenna mount 10, enabling quick attachment by hanging the central segment 4 upon the antenna mount 10, the inner diameter 16 of the disk 12 inserted within the annular groove 22. If a higher level of retention is desired, additional retaining roller(s) 14 may also be installed upon the lower portion, once the disk 12 is hung upon the antenna mount 10. Similarly, the load against the antenna mount 10 may be supported along the surface of the annular disk by additional support such as rollers and or wear pad(s) 18.

In alternative embodiments, the rotatable connection 8 may be formed integral with the central segment as a single monolithic portion, an inner diameter 16 provided in a back face of the central segment 4, including an annular shoulder to provide an equivalent surface to that of the disc 12 inner diameter 16 for engaging the retaining roller(s) 14, or the like, as described herein above.

The rotatable connection 8 may be lockable at a desired rotation position for example via a spring loaded locking pin 23 that engages a corresponding lock hole 24 of the disk 12 outer surface 20. A plurality of lock hole(s) 24 may be applied to enable locking the disk 12 and thereby the reflector 2 at a range of different positions.

Figure 3:
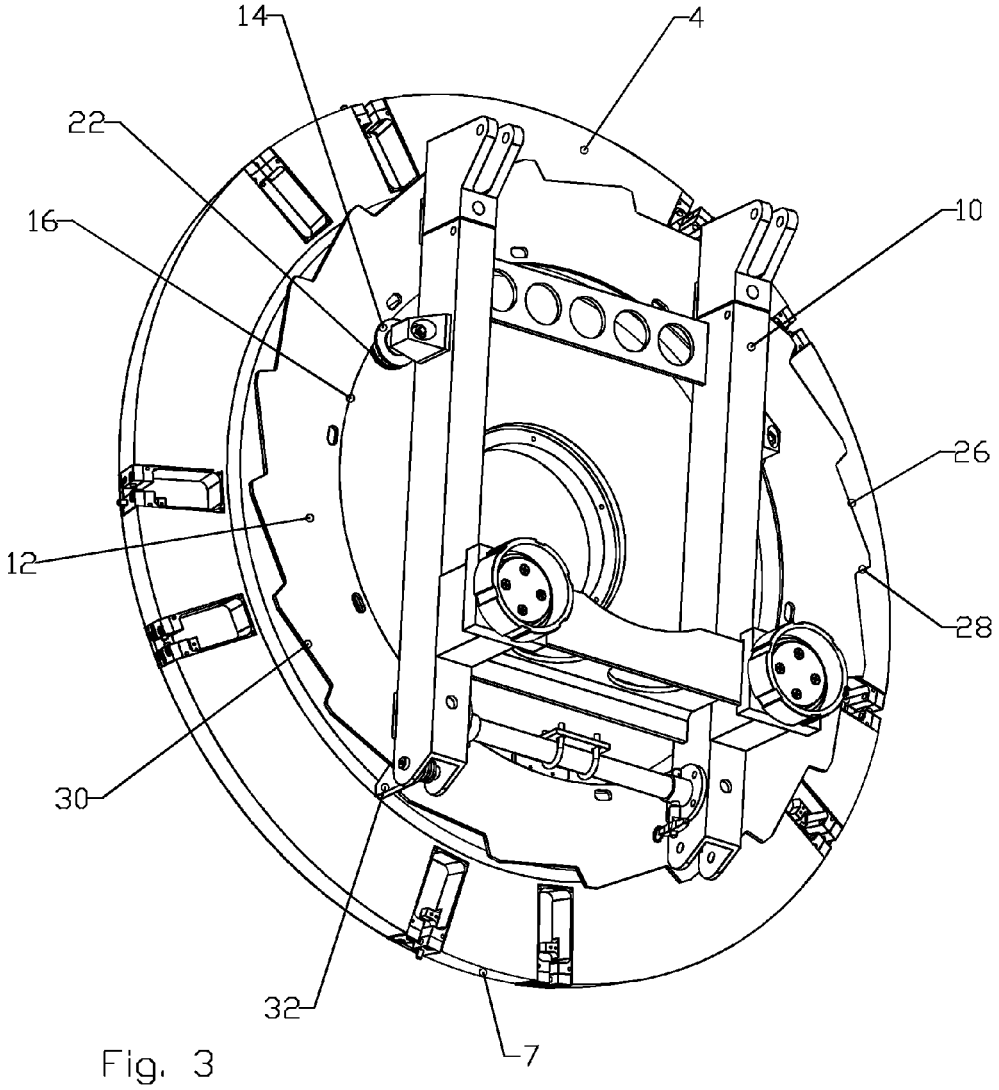
FIG. 3 is a close-up isometric view of a second embodiment, with the reflector peripheral reflector segments removed for clarity.
Figure 4:
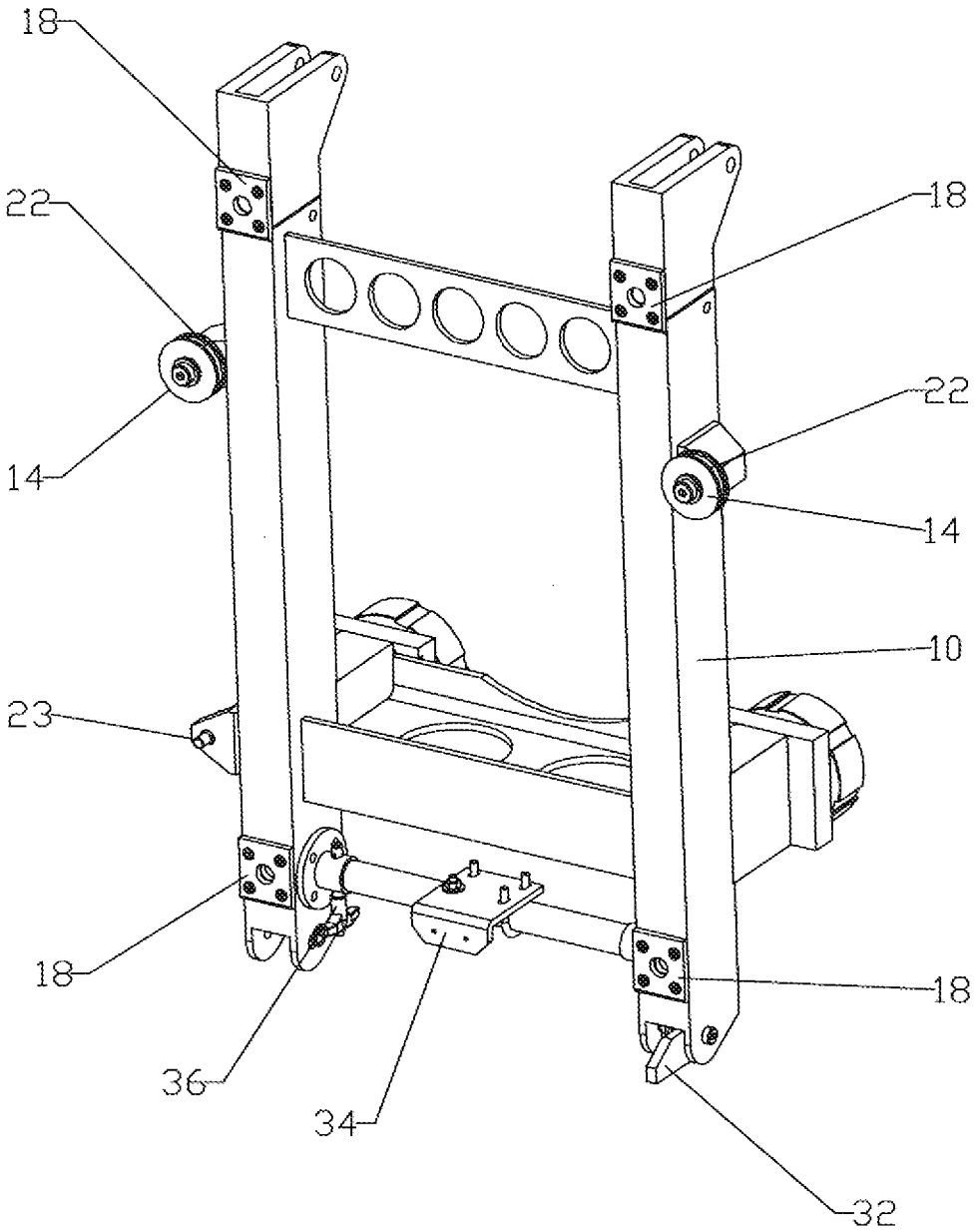
FIG. 4 is a close-up isometric view of the disc side of the antenna mount in FIG. 3.

In a second exemplary embodiment, shown for example in FIGS. 3 and 4, an outer diameter 26 of the disk 12 is formed with a series of step(s) 28 separated by angled transition(s) 30 that co-operate with a, for example spring loaded, ratchet arm 32 of the antenna mount 10. As the reflector 2 and disk 12 is rotated in a first direction with respect to the antenna mount 10, the ratchet arm 32 slides along the angled transition(s) 30 connecting the top and bottom of adjacent step(s) 30. However, when rotation is attempted in a reverse direction, the ratchet arm 32 locks against the step(s) 30 themselves, allowing freewheeling rotation of the reflector 2 central segment 4 and any attached peripheral segment(s) 6 in only a single direction.

A safety clamp 34 may be applied to secure the bottom of the disc 12 from pivoting away from the antenna mount 10 and or from being lifted off of engagement with the retaining rollers 14. The safety clamp 34 may be a hook arrangement that the central segment 4 and disc 12 are together engaged around before lowering the disc 12 upon the upper retaining roller(s) 14, or the safety clamp 34 may be pivotable between a securing position behind the disc 12 and an open position, securable in the locked position by, for example, a retaining pin 36.

In further variations, one direction rotation interlocks may be applied similar to the first embodiment via a ratchet arm or locking pin 23 that mates with the lock hole(s) 24. An angled end face may be applied to the locking pin 23, against which a single direction of rotation is operable. To retain the locking pin 23 rotation interlock function, the locking pin 23 is configured to be rotatable to turn the angled end face so that neither direction of rotation engages a sloped side of the angled end face when a full rotation interlock is desired.

Via the single direction freewheeling rotation, each of the peripheral segment(s) 6 may be attached to a bottom portion 7 of the central segment 4 and any adjacent peripheral segment(s) 6 while at the bottom position. As each peripheral segment 6 is attached, the reflector 2 is rotated to allow attachment of the next peripheral segment 6 also at the bottom position. Similarly, additional rings of peripheral segment(s) 6 may also be added to the ring of peripheral segment(s) 6 attached to the central segment 4.

Figure 5:
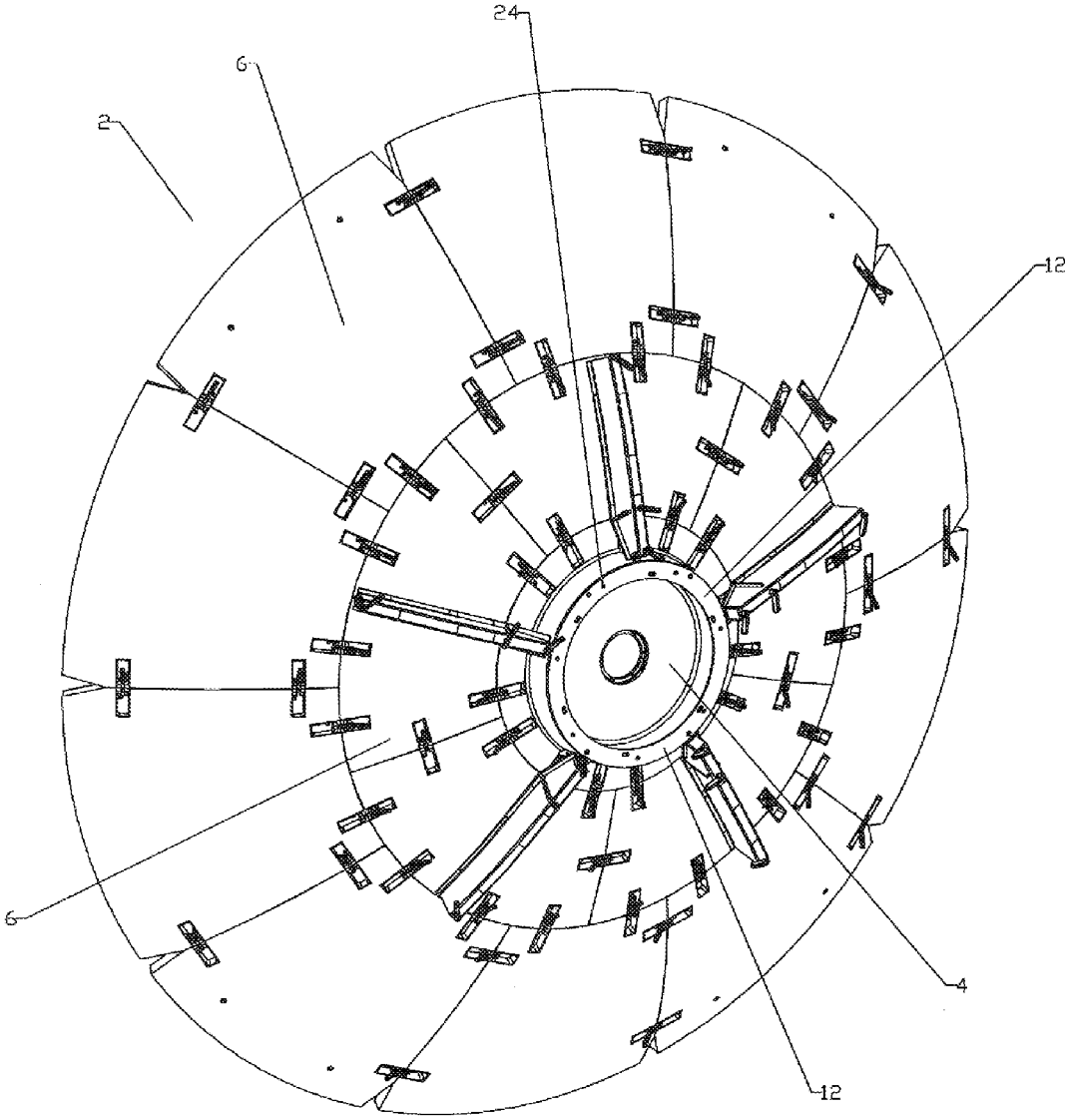
FIG. 5 is an isometric back view of a reflector with reinforcing structures.
Figure 6:
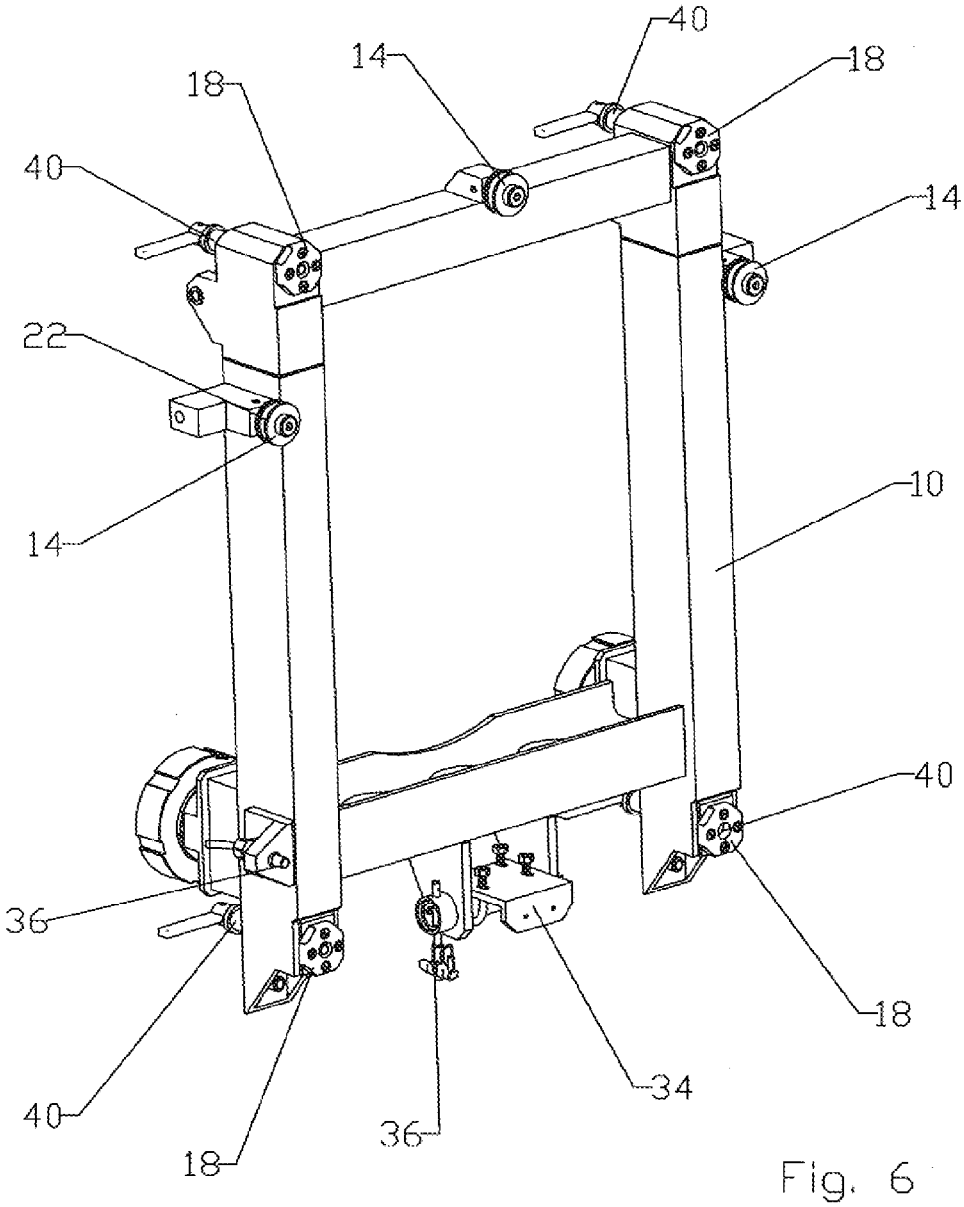
FIG. 6 is an isometric front view of an antenna mount third embodiment.
Figure 7:
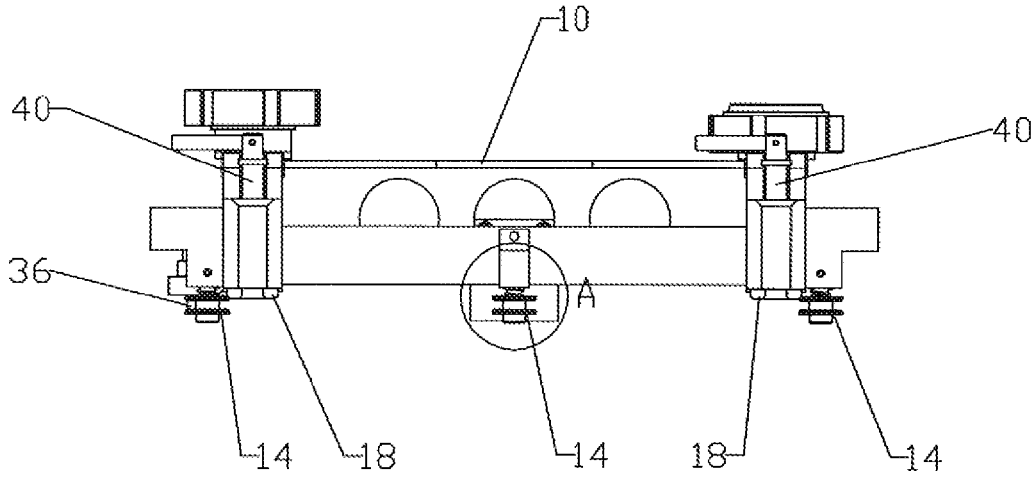
FIG. 7 is a top view of the antenna mount of FIG. 6.
Figure 8:
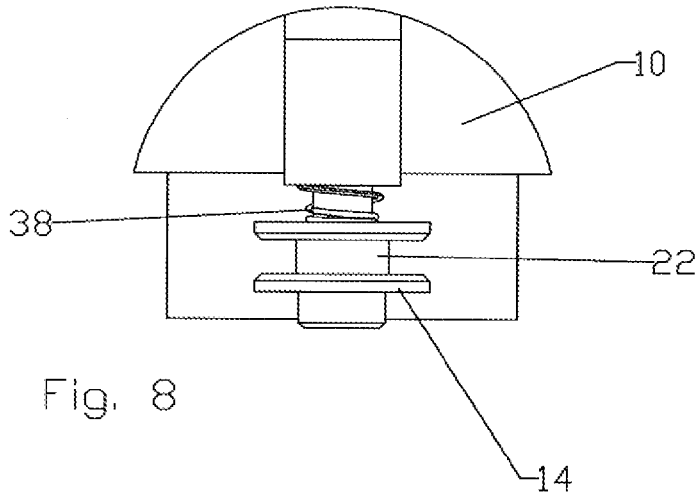
FIG. 8 is a close-up view of section A of FIG. 7.
Figure 9:
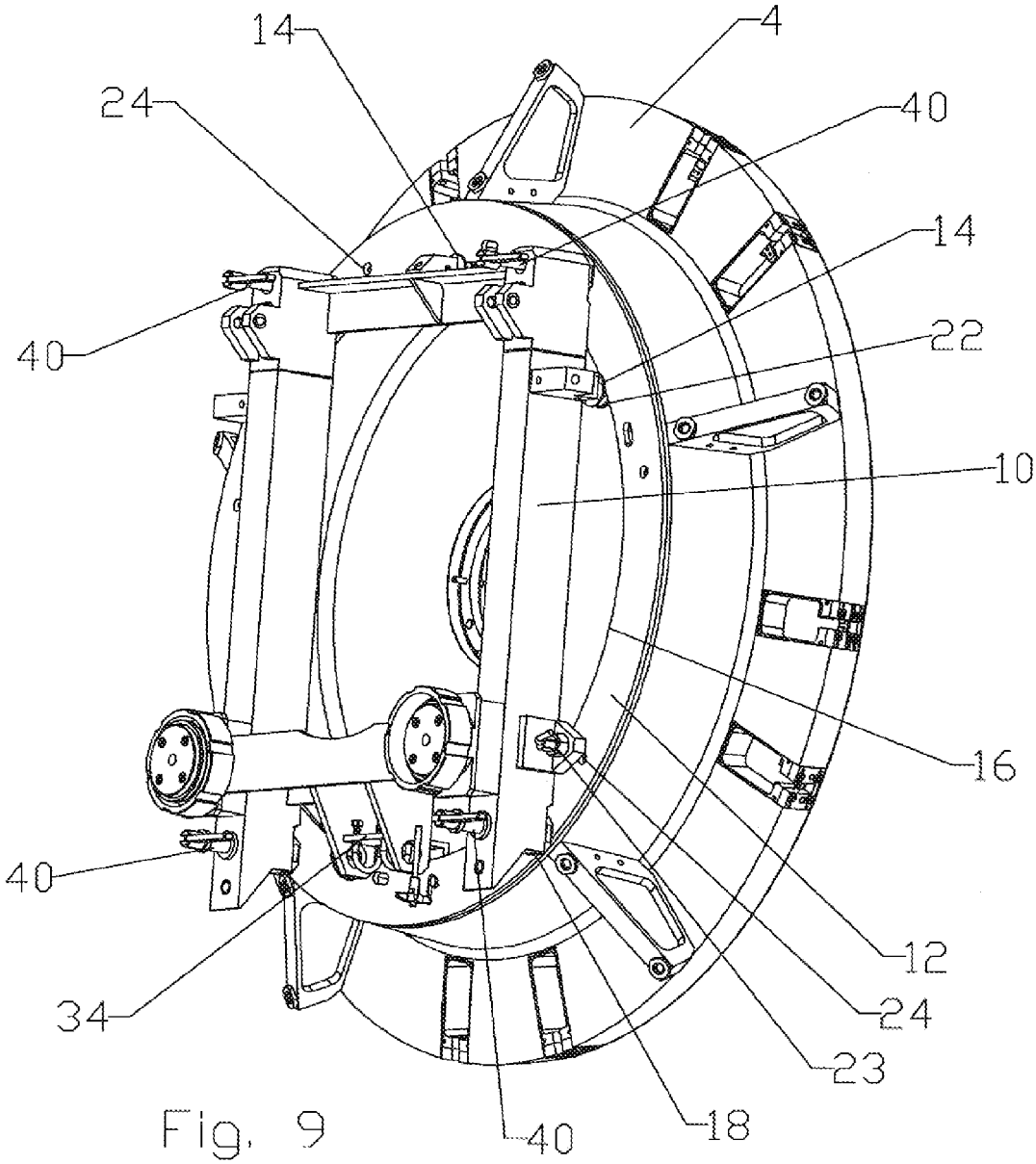
FIG. 9 is an isometric view of the antenna mount of FIG. 6, shown coupled to the central segment of FIG. 5.

A third exemplary embodiment, as demonstrated in FIGS. 5-9, demonstrates that where the reflector 2 has reinforcing structures, for example as shown in FIG. 5, the disc 12 mounting point may be spaced outward on the central segment 4 to maintain rotatability of the reflector 2 during assembly without interference with the reinforcing structures. To minimize wear on and or excessive friction from the wear pad(s) 18, the retaining roller(s) 14 may be provided with a spring 38, best shown in FIG. 7, biased to space the retaining roller(s) 14 and thereby the disc 12 mounted thereon away from the antenna mount 10 and thus contact with the wear pad(s) 18. After reflector 2 assembly is completed, the reflector 2 may be secured in a fixed rotational position by retaining fastener(s) 40 such as toggle bolts that thread into an array of the lock hole(s) 24 spaced to securely orient the reflector 2 and associated feeds and or transceivers, for example, at a rotation angle for reception of a desired signal polarization. To prevent the retaining fastener(s) 40 from interfering with rotation of the reflector 2 during assembly, the retaining fastener(s) 40 may also be configured with springs to bias them away from the disc 12, until interconnection is desired.

One skilled in the art will appreciate that, because the reflector 2 rotates in only one direction and or only between selectable lockable positions, even though unbalanced prior to completed assembly, only manipulation of each peripheral segment 6 at the ground level for connection to the central segment 4, or a peripheral segment 6 connected to the central segment 4 is required. Thereby, the need for overhead or other form of heavy lift capacity at the assembly location is eliminated, greatly improving the mobility and assembly efficiency of the antenna.

Table of Parts

| | |
|---|---|
| 2 | reflector |
| 3 | rotatable antenna mount |
| 4 | central segment |
| 6 | peripheral segment |
| 7 | bottom portion |
| 8 | rotatable connection |
| 10 | antenna mount |
| 12 | disk |
| 14 | retaining roller |
| 16 | inner diameter |
| 18 | wear pad |
| 20 | outer surface |
| 22 | annular groove |
| 23 | locking pin |
| 24 | lock hole |
| 26 | outer diameter |
| 28 | step |
| 30 | angled transition |
| 32 | ratchet arm |
| 34 | safety clamp |
| 36 | retaining pin |
| 38 | spring |
| 40 | retaining fastener |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A method for assembly of a segmented reflector antenna, including the steps of:

coupling a central segment upon an antenna mount;

attaching a peripheral segment to a bottom portion of the central segment;

rotating the central segment to present a bottom portion of the central segment without a peripheral segment, and attaching a peripheral segment to the bottom portion of the central segment without a peripheral segment.

2. The method of claim 1, further including the step of rotational interlocking the central segment with respect to the antenna mount after rotating the central segment to present a bottom portion of the central segment without a peripheral segment.

3. The method of claim 1, further including the step of applying a secondary ring of the peripheral segments, each connected to an outer edge of a peripheral segment connected to the bottom portion of the central segment.

4. The method of claim 1, wherein rotation of the central segment is via a rotatable connection provided as a disc with an inner diameter, an outer diameter and a generally planar outer surface; the rotatable connection coupled to the central segment;

the rotatable connection coupled to the antenna mount having a reflector connection plane; the outer surface parallel to the reflector connection plane, the rotatable connection, and thereby the antenna reflector is rotated about a rotation axis normal to the reflector connection plane.

5. The method of claim 4, further including the step of applying a secondary ring of the peripheral segments, each connected to an outer edge of a peripheral segment connected to the bottom portion of the central segment.

6. The method of claim 4, further including the step of rotational interlocking the central segment with respect to the antenna mount after rotating the central segment to present a bottom portion of the central segment without a peripheral segment; the rotational interlocking performed by inserting a locking pin coupled to the antenna mount into one of a plurality of lock holes formed in the outer surface.

7. The method of claim 6, further including the step of applying a secondary ring of the peripheral segments, each connected to an outer edge of a peripheral segment connected to the bottom portion of the central segment.

8. The method of claim 4, wherein the rotation of the central segment is in a single direction; the rotation of the central segment in a single direction enabled by a plurality of steps, connected by angled transitions, in the disc outer diameter; and a ratchet arm pivotably coupled to the antenna mount operable to engage the outer diameter whereby rotation of the disc in a first direction is enabled by the ratchet arm sliding along the angled transitions and rotation of the disc in a reverse direction is prohibited by the ratchet arm impacting a step.

9. The method of claim 8, further including the step of applying a secondary ring of the peripheral segments, each connected to an outer edge of a peripheral segment connected to the bottom portion of the central segment.

* * * * *